US009731403B2

(12) United States Patent
Lin

(10) Patent No.: US 9,731,403 B2
(45) Date of Patent: Aug. 15, 2017

(54) HAND-HELD CONFORMABLE SANDING BLOCK

(71) Applicant: Trade Associates, Inc., Kent, WA (US)

(72) Inventor: Bang Fang Lin, Huatan (TW)

(73) Assignee: Trade Associates, Inc., Kent, WA (US)

( * ) Notice: Subject to any disclaimer, the term of this patent is extended or adjusted under 35 U.S.C. 154(b) by 0 days.

(21) Appl. No.: 15/248,245

(22) Filed: Aug. 26, 2016

(65) Prior Publication Data

US 2016/0361798 A1 Dec. 15, 2016

Related U.S. Application Data

(62) Division of application No. 14/044,567, filed on Oct. 2, 2013, now Pat. No. 9,427,847.

(60) Provisional application No. 61/709,048, filed on Oct. 2, 2012.

(51) Int. Cl.

| | |
|---|---|
| ***B24B 37/00*** | (2012.01) |
| ***B24D 3/00*** | (2006.01) |
| ***B24D 15/04*** | (2006.01) |

(52) U.S. Cl.

CPC ..... *B24D 15/04* (2013.01)

(58) Field of Classification Search

None

See application file for complete search history.

(56) References Cited

U.S. PATENT DOCUMENTS

| | | | | |
|---|---|---|---|---|
| 4,202,139 | A | 5/1980 | Hong et al. | |
| 4,981,734 | A | 1/1991 | Akao et al. | |
| 6,503,612 | B1 * | 1/2003 | Copeland | B24D 15/04 428/220 |
| 7,169,029 | B2 | 1/2007 | Petersen et al. | |
| 7,569,262 | B2 | 8/2009 | Szabo et al. | |
| 8,057,286 | B2 | 11/2011 | Walsh | |
| 9,427,847 | B2 | 8/2016 | Lin et al. | |
| 2005/0266226 | A1 * | 12/2005 | Obeng | B24B 37/24 428/304.4 |

FOREIGN PATENT DOCUMENTS

| | | | |
|---|---|---|---|
| CN | 2356807 | Y | 1/2000 |
| CN | 1320073 | A | 10/2001 |
| JP | 411277449 | | 10/1999 |
| WO | 2011118762 | | 9/2011 |
| WO | 2011118762 | A1 | 9/2011 |

OTHER PUBLICATIONS

Examiner's Report received for CA Appl. No. 2,885,629 dated Jan. 13, 2017.

Second Office Action received for CN Appl. No. 201380051696.4 dated Nov. 23, 2016.

European Search Report for Appln No. 13 843 129.1dated Jun. 14, 2016.

First Office Action received for PRC (China) Patent Appl. No. 201380051696.4 dated Mar. 30, 2016.

International Search Report and Written Opinion for PCT/US2013/063098 dated Dec. 27, 2013.

Office Action received for CA Application 2,885,629 dated Apr. 1, 2016.

Third Office Action received for CN Appl. No. 201380051696.4 dated Apr. 18, 2017.

* cited by examiner

*Primary Examiner* — Ana Woodward

(74) *Attorney, Agent, or Firm* — Dorsey & Whitney LLP

(57) ABSTRACT

An elastomeric sanding block conformable to curved or flat surfaces includes a Shore A hardness ranging from about 30 to about 90, and is made from ethylene-vinyl acetate copolymer, low-density polyethylene or an admixture thereof. The polymer or admixture ranges from about 35 to about 70 percent of the sanding block composition by weight. A blowing agent is present in an amount that ranges from about 1.5 to about 4.5 percent of the composition by weight. The elastomeric sanding block may be formed by combining the polymer or admixture and other components under heat to yield a feedstock, thermoforming the feedstock in a mold to yield a foamed material sheet, and cutting the foamed material sheet.

13 Claims, No Drawings

HAND-HELD CONFORMABLE SANDING BLOCK

CROSS-REFERENCE TO RELATED APPLICATION

This application is a divisional of U.S. application Ser. No. 14/044,567 filed on Oct. 2, 2013, issued as U.S. Pat. No. 9,427,847 on Aug. 30, 2016, which claims priority to U.S. Provisional Application No. 61/709,048 filed on Oct. 2, 2012, the entire contents of all of which are incorporated by reference herein in their entirety.

TECHNICAL FIELD

Implementations provide sanding block compositions and methods of manufacturing sanding blocks. More particularly, the sanding blocks include one or both of ethylene-vinyl acetate copolymer and low-density polyethylene along with a blowing agent, among other components, resulting in conformable sanding blocks.

BACKGROUND OF THE INVENTION

Sanding blocks used to hold sandpaper are available in many varieties and are typically used for smoothing and polishing rough or irregular surfaces. Traditionally, sanding blocks are wood or cork blocks with one smooth, flat side adapted to receive sandpaper around its exterior. Other sanding blocks are made of rubber or other resilient material and use holding clamps, sharp teeth or clips to secure sandpaper along the exterior. Although these traditional sanding blocks are widely used on flat surfaces, their use on curved surfaces is problematic. In particular, traditional sanding blocks have relatively large flat sandpaper support surfaces, which do not conform to the shape of curved surfaces. Use of such sanding blocks on curved surfaces often results in uneven sanding, mainly because these blocks are not pliable to the curvature of the surface being sanded, and because excessive pressure is often applied to some portions of the surface being sanded. The application of excessive pressure may result in over-sanding and rapid deterioration of the sandpaper, which may also damage the underlying surface being smoothed or polished.

Sanding blocks are frequently used in the automobile repair industry for sanding both flat and curved surfaces. For instance, sanding of automobile bodies prior to repainting involves both flat and curved surfaces of the automobiles. Given this constantly evolving industry, automobiles have numerous designs, each unique and different from the other. Some automobile body parts are relatively smooth with slight curvatures, and thus are difficult to sand evenly. Conventional sanding blocks result in a rippling effect along such sanded surfaces. Conversely, other body parts in an automobile are flat, but nevertheless require sanding without damaging the adjoining curved areas. This necessitates a need in the art for sanding blocks that are readily conformable to flat as well as curved surfaces. The sanding blocks disclosed herein fill this need and provide further related advantages.

SUMMARY OF THE INVENTION

The present disclosure provides compositions and methods of manufacturing sanding blocks that are readily conformable to curved as well as flat surfaces. Implementations may be useful in applications in which the sanding block provides rigidity to support sandpaper on flat surfaces, yet has the pliability to support sandpaper on curved surfaces. Although the terms "sanding block" and "sanding" are used throughout the specification, it will be understood that the sanding block may also be used in applications such as polishing and buffing.

According to certain implementations, an elastomeric sanding block has a Shore A hardness ranging from about 30 to about 90, and is composed of a plurality of components comprising ethylene-vinyl acetate copolymer (commonly known as "EVA"), low-density polyethylene (commonly known as LDPE") or an admixture of ethylene-vinyl acetate copolymer copolymer and low-density polyethylene. The polymer or admixture further includes a blowing agent. In some implementations, the composition further includes one or more fillers (e.g., calcium carbonate), metallocene catalyzed ethylene-α-olefin copolymers, processing additives (e.g., zinc stearate, zinc oxide, titanium oxide, and an organic oxide), plasticizers, and extenders.

Implementations are also directed to a method for manufacturing an elastomeric sanding block conformable to curved or flat surfaces and includes the steps of either providing ethylene-vinyl acetate copolymer or low-density polyethylene or forming an admixture of ethylene-vinyl acetate copolymer and low-density polyethylene, wherein the admixture is in an amount that ranges from about 35 to about 70 percent composition by weight, followed by combining the admixture with a blowing agent, such as azodicarbonamide, to yield a feedstock, and thermoforming the feedstock in a mold to yield a foamed material sheet. The resulting foamed material sheet is cut in desired shapes and sizes to yield elastomeric sanding blocks.

DETAILED DESCRIPTION

The present disclosure is directed to compositions and methods for producing sanding blocks. The sanding blocks may be readily conformable to a variety of surface features encountered during sanding, buffing and polishing applications. The sanding blocks may contain one or both of ethylene-vinyl acetate copolymer and low-density polyethylene combined in a variety of relative amounts. In some aspects, the sanding blocks also include other components such as blowing agents, metallocene catalyzed ethylene-α-olefin copolymers, α-olefin copolymers (e.g., TAFMER produced by Mitsui Chemicals), processing additives, pigments and appropriate fillers. In one aspect, the sanding blocks are manufactured by combining ethylene-vinyl acetate copolymer and low-density polyethylene, and combining the resulting admixture with a blowing agent under heat to yield a feedstock, followed by thermoforming the feedstock in a mold and cutting the resulting material sheet to yield the sanding blocks.

Although various implementations are set forth below, it will be clear to one skilled in the art that the present disclosure may include additional embodiments, or that the disclosure may be practiced without several of the details described herein. In some instances, procedural steps have not been described in detail in order to avoid unnecessarily obscuring the described aspects of the disclosure.

A brief review of polymer nomenclature is provided to aid in the understanding of the present invention. In general, a polymer is a macromolecule (i.e., a long chain molecular chain) synthetically derived from the polymerization of monomer units, or which naturally exists as a macromolecule (but are still derived from the polymerization of monomer units). The individual units comprising the molecular chain are the monomer units. For example, polyethylene is a polymer derived from the monomer ethylene (CH2=CH2). More specifically, polyethylene is a "homopolymer"—that is, a polymer consisting of a single repeating unit, namely, the monomer ethylene (CH2=CH2).

In contrast, a "copolymer" is a polymer containing two (or more) different monomer units. A copolymer may generally be synthesized in several ways. For example, a copolymer may be prepared by the copolymerization of two (or more) different monomers. Such a process yields a copolymer where the two (or more) different monomers are randomly distributed throughout the polymer chain. These copolymers are known as "random copolymers." Alternatively, copolymers may be prepared by covalent coupling or joining of two homopolymers. For example, the covalent coupling of one homopolymer to the terminus of a second, different homopolymer provides a "block copolymer." A block copolymer containing homopolymer A and homopolymer B may be schematically represented by the following formula: (A)x (B)y where (A)x is a homopolymer consisting of x monomers of A, (B)y is homopolymer consisting of y monomers of B, and wherein the two homopolymers are joined by a suitable covalent bond or linking spacer group. While the above formula illustrates a block copolymer having two block components (i.e., a "di-block copolymer"), block copolymers may also have three or more block components (e.g. a "tri-block copolymer" schematically represented by the formula (A)x(B)y(A)x or simply A-B-A, as well as a "multiblock copolymer" schematically represented by the formula $(A\text{-}B)_n$).

The elastomeric sanding blocks provided herein include a Shore A hardness (ASTM D2240) ranging from about 30 to about 90 and may contain a polymeric composition formulated from a variety of components as follows.

Ethylene-Vinyl Acetate Copolymers:

Ethylene-vinyl acetate copolymers are derived from random copolymerization of acetate and ethylene. In general, the ethylene-acetate copolymer has a vinyl acetate component ranging from 9 percent to 40 percent by weight, density generally ranging from 0.92 to 0.96 gm/cm$^3$, melt index (ASTM D-1238) generally ranging from 0.3 to 43, and melting point generally ranging from 145 to 212° F. The ethylene-vinyl acetate copolymer may be selected from any of readily available commercial grades (e.g., Elvax, Dupont Industrial Polymers, United States). In some implementations, the ethylene-vinyl acetate copolymer may be used to produce relatively soft elastomeric sanding blocks such as when certain softness of the product is being demanded. Further, in some implementations, the ethylene-vinyl acetate copolymer may be present in the sanding block in an amount that ranges from about 35 to about 70 percent of the composition by weight.

Low-Density Polyethylene:

Low-density polyethylene is made from the monomer ethylene. It has a high degree of short and long chain branching, which results in a structure where the chains do not pack into a crystal structure too tightly, giving low-density polyethylene increased ductility. Its density ranges from 0.91 to 0.925 gm/cm$^3$, while its melting point is about 221 to 248° F. and melt index (ASTM D-1238) is about 1.25 g/10 min. The small amount of branching gives low-density polyethylene high resilience making it substantially unbreakable, yet flexible. Low-density polyethylene may be manufactured by free radical polymerization, and may be selected from any of readily available commercial grades (e.g., DOW LDPE, Dow Chemicals, United States; Exxon-Mobil LDPE, Exxon Mobil Chemicals). The addition of low-density polyethylene in elastomeric sanding blocks may result in relatively rigid and hard elastomeric sanding blocks, which may provide a sanding block with relatively high rigidity and hardness. In some implementations, the low-density polyethylene may be present in the sanding block in an amount that ranges from about 35 to about 70 percent of the composition by weight.

Admixture of Ethylene-Vinyl Acetate Copolymer and Low-Density Polyethylene:

In some implementations, the sanding blocks may be composed primarily of an admixture of the ethylene-vinyl acetate copolymer and the low-density polyethylene. As is known in the art, ethylene-vinyl acetate copolymers are generally available as random copolymers, whereas low-density polyethylene copolymers are available as homopolymers. In some implementations, the admixture of ethylene-vinyl acetate copolymer and a low-density polyethylene ranges from about 35 to about 70 percent of the composition by weight, and within the admixture, the amount of low-density polyethylene may range from about 10 to about 30 percent of the admixture and the amount of ethylene-vinyl acetate copolymer may range from about 70 to about 90 percent of the admixture.

In some implementations, the addition of low-density polyethylene to the ethylene-vinyl acetate copolymer results in a wide range of product hardness applicable to various sanding purposes.

In order to facilitate processing of the ethylene-vinyl acetate copolymer, the low-density polyethylene or admixtures thereof may comprise various additives such as blowing agents, various oils, plasticizers, fillers, pigments, and extenders, as well as other specialty additives.

Blowing Agents:

In certain implementations, blowing agents containing at least one amine group may be added to the sanding block composition. A blowing agent is a chemical added to an admixture of materials that undergo hardening or phase transition such as polymers, to impart a cellular structure to the admixture, resulting in a polymeric foam. Mixing a blowing agent in an admixture supplies heat to the process and causes a thermal decomposition of the blowing agent. The blowing agent decomposes at elevated temperatures during processing of the polymer or admixture to generate gas, which forms a foam structure within the polymer matrix. Formation of a cellular structure also increases the relative stiffness of the original admixture. Addition of a blowing agent during processing of the polymer or admixture provides several benefits. It improves processing and ease of handling by reducing cycling time for the process as well as the weight of the admixture. Further, a cushion effect is created due to release of gas during the decomposition of the blowing agent, thus improving the comfort of use of resulting product. It also improves quality of the resulting product by eliminating surface imperfections and may yield a textured design, if desired.

Specialty blowing agents may further improve processing of the polymer or admixture by faster expansion rates and faster reduction in density of the resulting product. Further, some of these specialty blowing agents decompose much more efficiently than traditional agents resulting in high speed processing of admixtures.

Azodicarbonamide (AC, Hangzhou Haihong Fine Chemicals, China) is a type of blowing agent, widely used in the polymer and plastic industry. It is an exothermic blowing agent which decomposes around 200° C. and produces nitrogen, carbon monoxide, carbon dioxide and ammonia, which is trapped in the polymer or admixture as bubbles resulting in a foamed final product. Azodicarbonamide may be modified to decompose at lower temperatures to increase its compatibility with other components. Some of the other commonly used blowing agents include toluene sulfonyl hydrazide and P.P'-Oxybis (benzene sulfonyl hydrazide). The amount of blowing agent used may range from about 1.5 percent to about 4.5 percent of the composition by weight prior to decomposing.

In some implementations, a blowing agent may be combined with the ethylene-vinyl acetate copolymer to form the sanding block having Shore A hardness ranging from about 30 to about 90. In further implementations, the aforementioned sanding block may include other components that do not materially affect the hardness such as fillers, processing additives and pigments.

Metallocene Catalyzed Ethylene-α-Olefin Copolymer:

In some implementations, the polymer admixture may include a metallocene catalyzed ethylene-α-olefin copolymer, while other implementations may be free of this copolymer. The addition of metallocene catalyzed ethylene-α-olefin copolymer to ethylene-vinyl acetate copolymer, low-density polyethylene, or an admixture thereof, aids in enhancing the pliability and the elasticity of the resulting product.

The metallocene catalyzed ethylene-α-olefin copolymer may be one or more of an ethylene-butene copolymer, an ethylene-hexene copolymer, and an ethylene-octene copolymer. The alpha-olefin component of the ethylene-α-olefin copolymer generally ranges from about 2 percent to about 30 percent by weight of the copolymer. The metallocene catalyzed ethylene-α-olefin copolymers have densities generally ranging from 0.86 to 0.95 gm/cm$^3$, melt indexes (ASTM D-1238) ranging from about 0.2 to 30, and melting points ranging from 122 to 248° F. Additionally, the ethylene-octene copolymer used in various embodiments may be present in amounts up to about 5 percent of the composition by weight.

Processing Additives:

Processing additives may include any additive that aids in the processing, workability, or otherwise enhances the performance characteristics, of the materials and/or compositions to be formed into elastomeric sanding blocks. For example, one or more materials may be processed with the admixture to improve the admixture's processability and/or performance characteristics. Some of the commonly used processing additives include zinc stearate, stearic acid, zinc oxide, titanium oxide, organic peroxides etc. Zinc stearate, also known as Coinex-ZNST (PT. CMS Chemicals, Indonesia), acts as a lubricant and aids in reducing temperature during the processing of the admixture. In some embodiments, dicumyl peroxide (an organic peroxide) is used as a processing additive in amounts that range from about 0.35 percent to about 0.6 percent by weight of the composition.

Any number of various processing additives may be added to enhance one or more physical characteristics and properties of the elastomeric sanding blocks disclosed herein. Exemplary of such processing additives are those identified in Gachter R., Muiller H., The Plastic Additives Handbook, 4$^{th}$ ed., Hander Publishers, Munich, Germany (1996) (incorporated herein by reference in its entirety).

Fillers:

In various embodiments, a filler such as calcium carbonate may also be added to the polymer or admixture. Generally, the amount of filler ranges from about 25 percent to about 60 percent of the composition by weight in various embodiments.

Extending Oils:

Further, in some other embodiments, the ethylene-vinyl acetate and low-density polyethylene admixture may also be processed together with an extending oil that comprises carbonaceous material to reduce cost of the process, or improve physical properties of the resulting product.

Pigments:

Pigments such as carbon may be used in the sanding block composition and may range from about 5 percent to about 18 percent of the composition by weight.

Methods of Producing Sanding Blocks:

The various sanding block components, as identified above, may be processed together as an admixture in the following manner. First, dry components may be added to a first mixer (e.g., 350 lb. Capacity Henschel Mixer with cooler) and mixed. For example, the desired amount of one or both of the ethylene-vinyl acetate copolymer and low-density polyethylene is mixed with desired amounts of various processing additives and other specialty additives. The mixed dry blend may be allowed to reach a temperature of about 80° F. and may be fed to a second continuous mixer (e.g., via a Colortronic MH 60 dozing feeder to a 4 inch Farrel Continuous Mixer). The blades of the second continuous mixer may then be rotated (e.g., at 175 rpm) so as to cause the mixed dry blend to flux into a homogenous melt at elevated temperatures (e.g., 340° F.) and a selected amount of a cross-linking agent (e.g., an organic peroxide) and a blowing agent (e.g., azodicarbonamide) may be added to the admixture and further mixed into a molten composition.

The molten composition may then be transferred and further processed through a calendering machine so as to yield a uniform sheet of a desired thickness. As is appreciated by those skilled in the art, calendering involves extruding a mass of material between successive pairs of co-rotating, parallel rolls, which process yields a film or sheet. After calendering, the uniform sheet is thermoformed in a thermoforming machine to yield a foamed material sheet. Both calendering and thermoforming are widely used processes in the thermoplastics industry.

Following calendering and thermoforming, the foamed material sheet is cut into numerous strips of varying sizes, which may be used as hand-held sanding blocks conformable to curved or flat surfaces.

Although the present disclosure provides references to preferred embodiments, persons skilled in the art will recognize that changes may be made in form and detail without departing from the spirit and scope of the invention.

What is claimed is:

1. An elastomeric sanding block conformable to curved or flat surfaces, wherein the elastomeric sanding block has a Shore A hardness ranging from about 30 to about 90, and wherein the elastomeric sanding block is made from a composition free of ethylene-vinyl acetate copolymer, the composition comprising:

low-density polyethylene homopolymer, wherein low-density polyethylene is in an amount that ranges from about 35 to about 70 percent of the composition by weight; and a blowing agent in an amount that ranges from about 1.5 to about 4.5 percent of the composition by weight.

2. The elastomeric sanding block of claim 1 wherein the blowing agent contains at least one amine group.

3. The elastomeric sanding block of claim 1 wherein the blowing agent comprises one or more of azodicarbonamide, toluene sulfonyl hydrazide or benzene sulfonyl hydrazide.

4. The elastomeric sanding block of claim 1 wherein the composition further comprises a metallocene catalyzed ethylene-α-olefin copolymer.

5. The elastomeric sanding block of claim 1 wherein the composition further comprises one or more of a filler, a processing additive or a pigment.

6. An elastomeric sanding block conformable to curved or flat surfaces, wherein the elastomeric sanding block has a Shore A hardness ranging from about 30 to about 90, and wherein the elastomeric sanding block is made from a composition comprising:

a polymeric component, the polymeric component consisting of ethylene-vinyl acetate copolymer, wherein ethylene-vinyl acetate copolymer is in an amount that ranges from about 35 to about 70 percent of the composition by weight; and a blowing agent in an amount that ranges from about 1.5 to about 4.5 percent of the composition by weight.

7. The elastomeric sanding block of claim 6 wherein the blowing agent contains at least one amine group.

8. The elastomeric sanding block of claim 6 wherein the blowing agent comprises one or more of azodicarbonamide, toluene sulfonyl hydrazide or benzene sulfonyl hydrazide.

9. The elastomeric sanding block of claim 6 wherein the composition further comprises one or more of a filler, a processing additive, or a pigment.

10. A method for manufacturing an elastomeric sanding block conformable to curved or flat surfaces, comprising the steps of:

providing low-density polyethylene;

combining the low-density polyethylene with a blowing agent under heat to yield a feedstock;

thermoforming the feedstock in a mold to yield a foamed material sheet; and cutting the foamed material sheet to yield the elastomeric sanding block, wherein the feedstock is free of ethylene-vinyl acetate copolymer, and the low-density polyethylene is in an amount that ranges from about 35 to about 70 percent of the feedstock by weight.

11. An elastomeric sanding block made by the process of claim 10.

12. A method for manufacturing an elastomeric sanding block conformable to curved or flat surfaces, comprising the steps of:

providing a composition comprising a polymeric component, the polymeric component consisting of ethylene-vinyl acetate copolymer, wherein the ethylene-vinyl acetate copolymer is in an amount that ranges from about 35 to about 70 percent of the composition by weight;

combining the ethylene-vinyl acetate copolymer with a blowing agent under heat to yield a feedstock;

thermoforming the feedstock in a mold to yield a foamed material sheet; and cutting the foamed material sheet to yield the elastomeric sanding block.

13. An elastomeric sanding block made by the process of claim 12.

* * * * *